US006417780B1

(12) United States Patent
Naruke et al.

(10) Patent No.: US 6,417,780 B1
(45) Date of Patent: Jul. 9, 2002

(54) RADIO CONTROL DEVICE

(75) Inventors: Giichi Naruke; Youichi Konno; Masahiro Tanaka, all of Mobara (JP)

(73) Assignee: Futaba Corporation, Mobara (JP)

( * ) Notice: Subject to any disclaimer, the term of this patent is extended or adjusted under 35 U.S.C. 154(b) by 0 days.

(21) Appl. No.: 09/350,913

(22) Filed: Jul. 12, 1999

(30) Foreign Application Priority Data

Jul. 13, 1998 (JP) ..... 10-197725

(51) Int. Cl.[7] ..... G08G 19/00

(52) U.S. Cl. ..... 340/825.69; 340/825.72; 455/95; 455/98; 318/16; 318/581; 446/456

(58) Field of Search ..... 340/825.69, 825.72; 455/98, 92, 186.1, 95; 341/176; 318/16, 581, 584, 585, 586; 446/454, 456

(56) References Cited

U.S. PATENT DOCUMENTS 4,954,820 A * 9/1990 Kohno et al. ..... 340/825.69
5,280,634 A * 1/1994 Aneha ..... 455/95

* cited by examiner

*Primary Examiner*—Michael Horabik
*Assistant Examiner*—M Shimizu
(74) *Attorney, Agent, or Firm*—Oblon, Spivak, McClelland, Maier & Neustadt, P.C.

(57) ABSTRACT

A radio control device is provided that has the D/R function wherein the rate can be switched by a simple operation without impairing the operability of a stick. The adjustment value (rate) determining a relationship between stick operation amount and servo motor operation amount is switched at the changeover point arbitrarily set within a range of stick operation amounts. The rate 1 is 100% while the rate 2 is 60%. The point 1 is set to the position corresponding to about 65% of the maximum value of the stick operation amount in the right direction (or down direction). The point 2 is set to the position corresponding to about 85% of the maximum value of the stick operation amount in the left direction (or up direction). In the rate 2, the rudder does not effectively work over the range where the operation amount of the stick is relatively small. When the adjustment value exceeds the point, the mode enters the rate 1, so that the rudder works effectively. As a result, the servo can be largely controlled with a small operation amount of the stick.

16 Claims, 4 Drawing Sheets

RADIO CONTROL DEVICE

BACKGROUND OF THE INVENTION

1. Field of the Invention

The present invention relates to an improved radio control device that controls the operation amount of each of servo motors mounted on a manipulated object by controlling sticks mounted on a transmitter. More particularly, the present invention relates to a radio control device wherein adjustment values defining the relationships between stick operation amount and servo motor operation amount are automatically switched at a changeover point set within the operation amount range of a stick.

2. Description of the Prior Art

The radio control devices that remotely control mobile bodies such as automobiles, airplanes and helicopters have become widespread in model craft fields and in industrial fields. In the radio control device, the operation amount of a servo motor mounted on a manipulated body is controlled by operating the stick mounted on a transmitter. For example, in the model aircraft, the throttle, aileron, elevator, ruder, and others mounted on the fuselage are driven with servo motors. When a model airplane is operated with the radio control device, the servo motor for each element is driven to a desired amount by operating the stick of the transmitter so that each element is operated by a necessary amount.

There is, for example, the so-called snap roll as one technique for the performance of a model airplane. This is a technique of greatly moving the aileron, elevator and rudder in a fixed direction, thus sharply turning the fuselage in a stall state. For this technique, most airplanes are required to increase the rudder angle largely in comparison with the normal flight condition. However, when the maximum rudder angle is adjusted to the rudder angle at the snap roll, the flight control becomes difficult because of the excessive rudder control response during a normal flight. Moreover, since the spinning technique is performed by fully controlling the stick, the rudder angle in the normal flight results in fast rotation of the fuselage.

In such conditions, the dual rate (often represented as D/R) is useful. FIG. 5 is a diagram illustrating the D/R function and shows the relationships between stick operation amount and servo motor operation amount. As understood from FIG. 5, the dual function is a function of switching an adjustment value (rate) of the operation amount of a servo motor with respect to the operation amount of a stick, to one of two types of rate including rate 1 (100%) and rate 2 (60%). As shown in FIG. 6 related to FIG. 5, the operation amount of a servo motor, that is, rotational amount, has a maximum value of 60% and a maximum value of 100%.

In the acrobat flying such as the snap roll, two kinds of rate are set. These two rates include the rate (e.g. the rate 2 with a small rudder angle) corresponding to the rudder in a normal flight and the rate (e.g. the rate 1 with a large rudder angle) corresponding to the rudder angle for acrobat flying. An optimum rudder angle can be obtained according to a flight state by selectively setting the rates 1 and 2.

In a conventional radio control device, the transmitter has a switch (D/R switch) to selectively change the D/R function rates.

Unlike the D/R function, some aircraft has a dedicated function (snap roll-only function) for a snap roll that can move the servo to a position predetermined under the operation of a momentary switch.

However, in the case where the rate is switched using the D/R switch in the conventional radio control device, the switch operation must be performed before the stunt flying so that the operation is complicated. Particularly, since the snap roll is often combined into the performance, it is difficult to operate the switch during the acrobat flying.

Moreover, when the snap roll-only function is used, fingers are separated from the switch for the switch operation, so that the rudder correcting operation after the snap rolling is delayed.

SUMMARY OF THE INVENTION

The present invention is made to solve the above-mentioned problems.

Moreover, the objective of the invention is to provide a radio control device with a D/R function wherein the rate can be switched by a simple operation without impairing the operability of a stick.

The objective of the present invention is achieved by a radio control device, wherein the operation amount of each of servo motors mounted on a manipulated body is controlled by operating a stick mounted on a transmitter, and wherein an adjustment value (rate) determining a relationship between stick operation amount and servo motor operation amount is switched at the changeover point arbitrarily set within a range of stick operation amounts.

The radio control device defined comprises means (preset point setting section 10) for setting the changeover point; adjustment value setting means (rate setting section 9) for setting an adjustment value in the region in the front of or behind the changeover point; comparison means (comparator 13, 14) for comparing an operation amount from the stick with the changeover point; and adjustment value switching means (rate switcher 16) for selecting an adjustment value set by the adjustment value setting means based on the output of the comparison means; wherein a control signal is output based on a selected adjustment value and the operation amount of the stick.

In a radio control device according to the present invention, a stick mounted on a transmitter is operated in two directions oppositely to each other with respect to the origin point so that the operation amount of a servo motor mounted on a manipulated body is controlled in two directions oppositely to each other; and an adjustment value determining a relationship between stick operation amount and servo motor operation amount has a different value between an inner region sandwiched between two changeover points and outer regions other than the region, the two changeover points being arbitrarily set within a range of operation amounts of the stick and sandwiching the origin point.

In the radio control device according to the present invention, when a first changeover point is set within the stick operation amount range, a second changeover point is set at a position which is symmetrical with respect to the first changeover point via the origin point.

According to the present invention, the radio control device further comprises means for setting the changeover point; adjustment value setting means for setting the two adjustment values; comparison means for comparing an operation amount from the stick with the changeover point; and adjustment value switching means for selecting any one of two adjustment values set to the adjustment value setting means based on an output from the comparison means, whereby a control signal is output based on a selected adjustment value and an operation amount of the stick.

Moreover, in the radio control device according to the present invention, when first servo control of the first stick is performed with the changeover point arbitrarily set and the adjustment value, second servo control of the second stick is performed in a similar manner to the first servo control.

BRIEF DESCRIPTION OF THE INVENTION

This and other objects, features, and advantages of the present invention will become more apparent upon a reading of the following detailed description and drawings, in which.

DETAILED DESCRIPTION OF THE PREFERRED EMBODIMENT

An embodiment of the present invention will be described below with reference to FIGS. 1 to 4.

Figure 1:
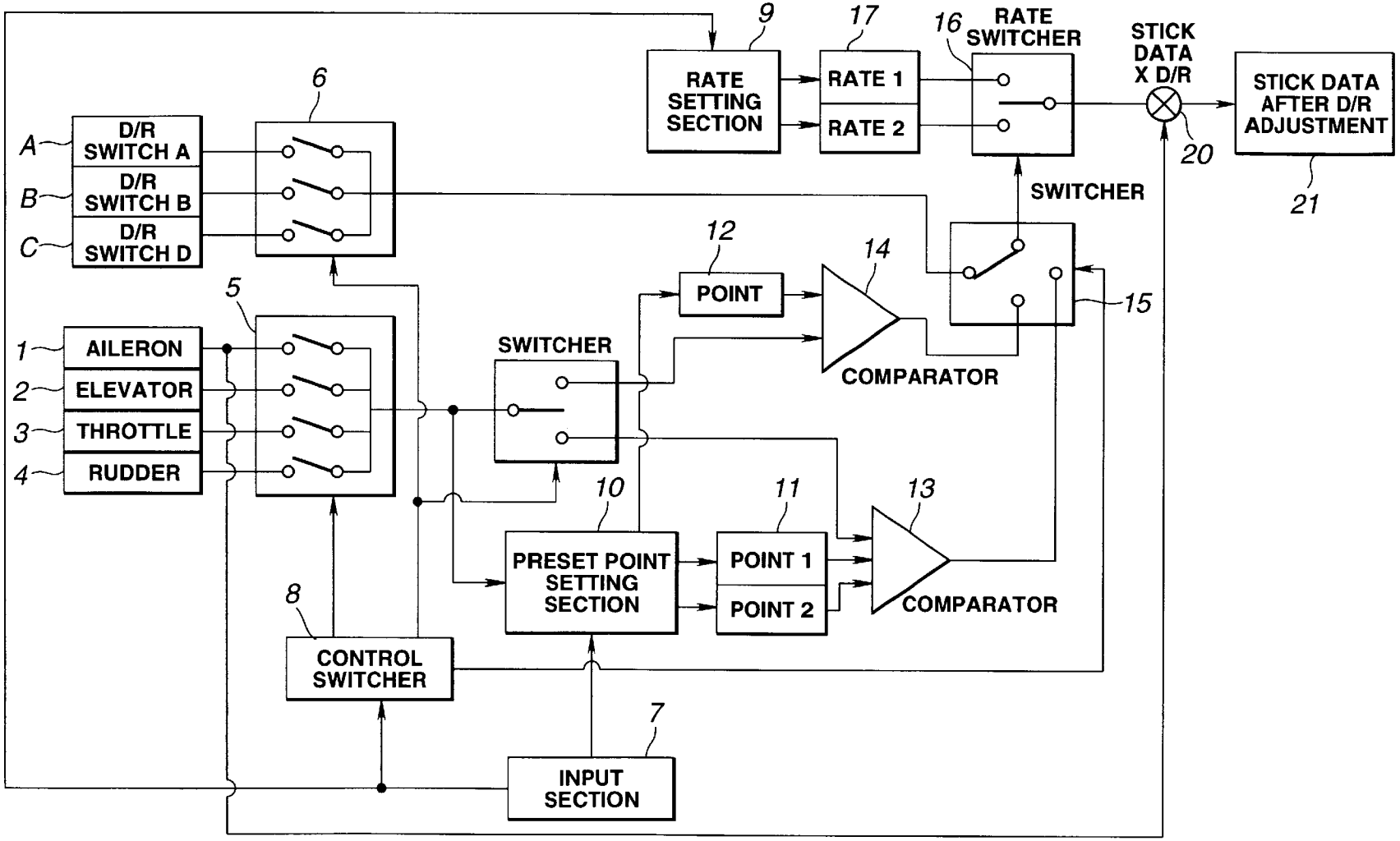
FIG. 1 is a block circuit diagram illustrating the configuration of a radio control device according to an embodiment of the present invention.

FIG. 1 is a block diagram showing the configuration of the transmitter side in a radio control device according to the present embodiment. The radio control device controls the operation of a model airplane. That is, when the stick mounted on the transmitter is operated, control signals (stick data after D/R) are produced. The control signals are transmitted to the manipulated body (airplane) to control servo motors on the manipulated body. The radio control device is characterized in that the changeover point can be arbitrarily set within a range of operation amounts of the stick and that the adjustment value (rate) determining the relationship between stick operation amount and servo motor operation amount can be automatically switched with respect to the changeover point being the boundary.

As shown in FIG. 1, the transmitter has four operation output means: operation output means for the aileron 1, operation output means for the elevator 2, operation output means for the throttle 3 and operation output means for the rudder 4.

As shown in FIG. 1, the transmitter has four operation output means, that is, the operation output means for the aileron 1, the operation output means for the elevator 2, the operation output means for the throttle 3 and the operation output means for the rudder 4. In the common radio-control transmitter, four operation output means are operated with sticks. Generally, a single stick can be moved in two directions perpendicular to each other at the same time, thus operating two kinds of operation. For example, the first stick controls the aileron 1 and the throttle 3 while the second stick controls the aileron 2 and the rudder 4. Hence, an operator can operate two sticks with the thumbs of his hands while the transmitter is held with his hands. Thus, the operator can operate four types of operation output means at the same time.

The radio control transmitter of FIG. 1 can transmit four kinds of operation amount. In order to avoid the complexity of the drawing, FIG. 1 depicts the case where data regarding the aileron is particularly handled.

The operation amount (stick data) of each of the operation output means obtained by operation of each stick is selectively output via the multiplexer 5. The rate (to be described later) is automatically changed according to the operation amount of a stick operating each operation output means. This operation is called hereinafter "automatic switching".

As shown in FIG. 1, the transmitter has three kinds of dual rate switches (D/R switches). The D/R switch A corresponds to the stick for elevator 2. The D/R switch B corresponds to the stick for elevator 4. The D/R switch D corresponds to the stick for aileron 1. The multiplexer 6 selectively output outputs from the D/R switches. The rate for desired operation output means can be manually selected by the D/R switch. This switching operation is hereinafter called "D/R switching".

As shown in FIG. 1, the transmitter includes an input section 7 and a control switcher 8. The control switcher 8 is functioned by the operation of the input section 7. Thus, it is decided whether the D/R switching is performed or the automatic switching by a stick is performed.

When the input section 7 is operated, the D/R rate can be set via the rate setting section 9 acting as adjustment value setting means. In this example, by operating the input section 7, the rate setting section 9 sets two rates including rate 1 and rate 2 to the storage means 17.

Moreover, the changeover point in an automatic switching operation (that is, a preset point) can be set by operating the input section 7. That is, the changeover point is the point where a set rate is automatically changed when the operation amount of a stick exceeds a certain point. In the case of the aileron 1, the elevator 2, or the rudder 4 of the present embodiment, the preset point setting section 10 acting as changeover point setting means sets two changeover points (including the point 1 and the point 2) by operating the input section 7 and then stores them in the storage means 11. In the case of the throttle 3, the preset point setting means 10 sets one point as a changeover point by operating the input section 7 and then stores it to the storage means 12.

Figure 2:
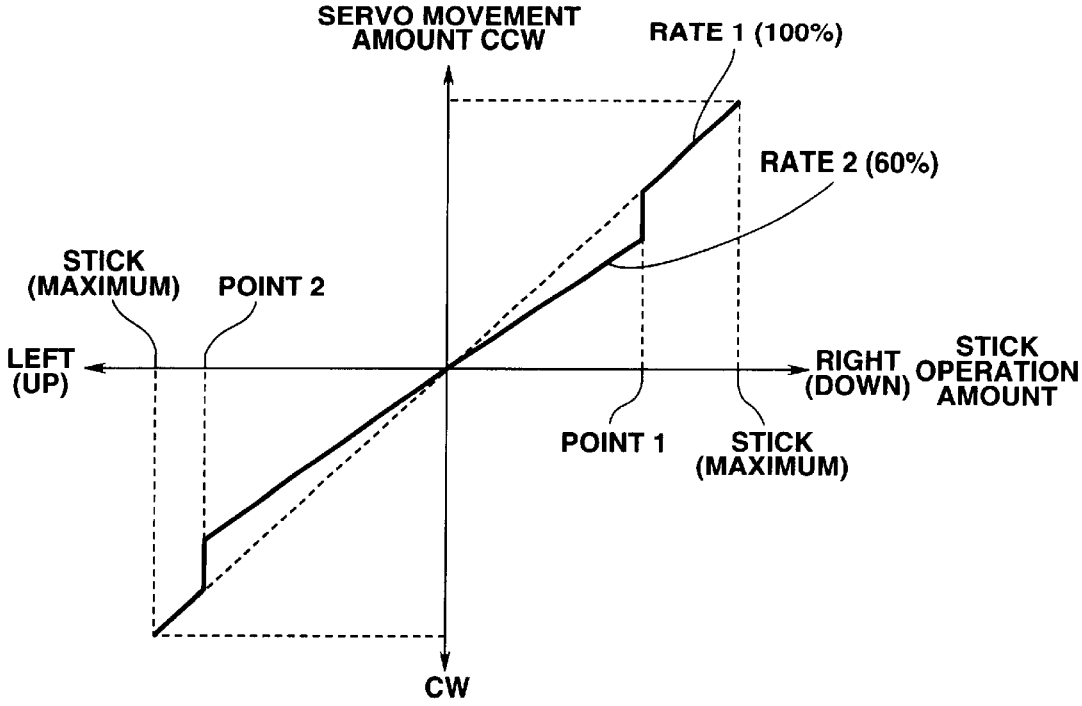
FIG. 2 is a control characteristic chart illustrating relationships between stick operation amount and servo operation amount according to an embodiment of the present invention.
Figure 3:
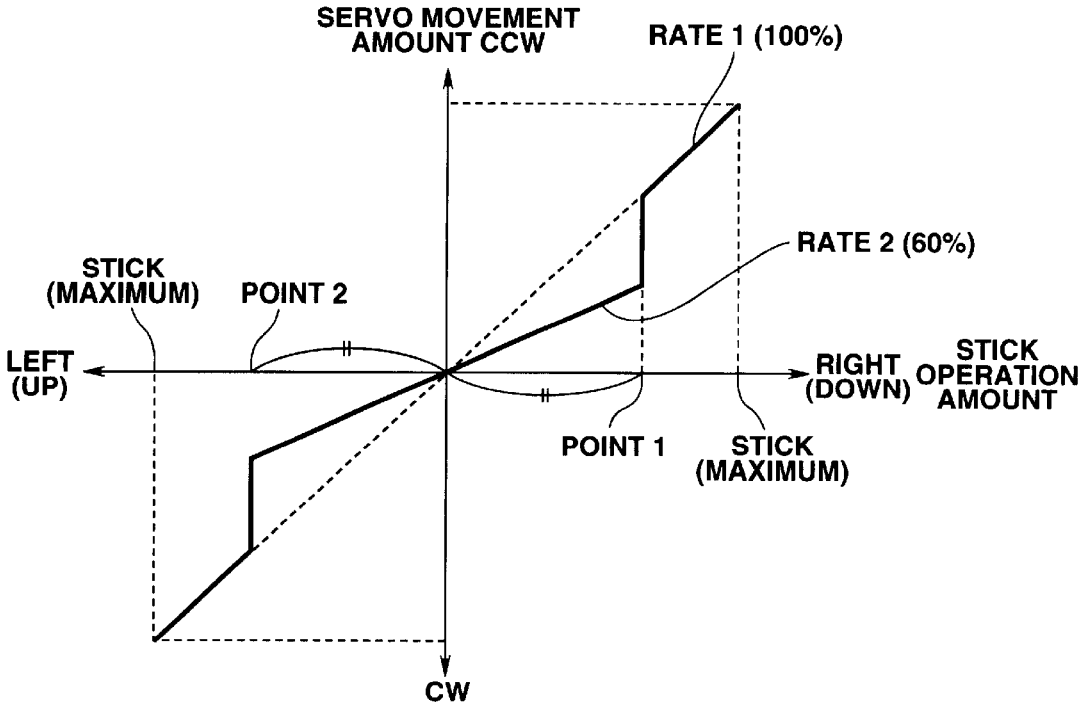
FIG. 3 is a control characteristic chart illustrating a relationship between stick operation amount and servo operation amount of a radio control device according to an embodiment of the present invention.

The case where the points and rates in an automatic switching according to the present embodiment are set will be described here. As shown in FIGS. 2 and 3, the x-axis represents the operation amount of a stick while the y-axis represents the operation amount of a servo motor.

In FIG. 2, the rate 1 is 100% while the rate 2 is 60%. The rate 1 is set to the point corresponding to about 65% of the maximum value of the stick operation amount in the right direction (or down direction). The rate 2 is set to the point corresponding to about 85% of the maximum value of the stick operation amount in the left direction (or up direction). The two points are not symmetrical with respect to the origin point. Points are set respectively.

In such a setting operation, the rudder in the rate 2 does not effectively work within a relatively small range of the stick operation amount. However, when the stick operation amount exceeds a certain point, the characteristic curve is transferred to the rate 1, so that the rudder works effectively. In other words, a small amount of the stick allows the servo to be operated largely. This setting operation is characterized in that the position of the point being a boundary differs in the operation direction of the stick. This setting is effective in the case where the necessary range of the rate 2 differs in the stick operation direction because of a peculiar characteristic of the fuselage.

Referring to FIG. 3, the rate 1 is 100% while the rate 2 is 60%. However, FIG. 3 differs from FIG. 2 in the point setting method. Two points are symmetrical with respect to the origin point. The two points are the points corresponding to about 70% of the maximum value. When one of the points is set, the other point can be automatically set to the position which is symmetrical with respect to the former point via the origin point.

According to the setting operation, the boundary of the stick operation amount where the rate is automatically varied is at the position symmetrical with respect to the origin point. That is, the setting operation is characterized in that the point where the servo response amount changes is the same in the positive and negative directions of the stick. The configuration of implementing the setting method facilitates the point setting.

As described above, the setting of the point and the rate can be performed using the rate setting section 9 and the preset point setting section 10.

As shown in FIG. 1, the transmitter has a comparator acting as comparison means that compares the operation amount from a stick with the changeover point. The first comparator 13 compares the operation amount of a stick operating the aileron 1, the elevator 2, or the rudder 4 with the point 1 or 2. Thus, the first comparator 13 detects whether the stick operation amount is within the inner region between the points 1 and 2 (on the origin point side in a to-and-fro movement of a stick) or is within an outer region other than the inner region. The second comparator 14 compares the operation amount of a stick operating the throttle 3 with a unique point.

Reffering to FIG. 1, the switcher 15 selectively switches the output signal from the D/R switches A, B or D, the output signal from the first comaprator 13 and the output signal from the second comparator 14 to the rate switcher 16 by a direction from the control switcher 8.

The rate switcher 16 acting as adjustment value switching means selects two rates set to the storage means 17, based on the output signal from the D/R switches A, B or D, the output signal from the first comparator 13 and the output signal from the second comparator 14.

As shown in FIG. 1, the adjustment section 20 adjusts the stick operation amount according to the rate selectively output by the rate switcher 16 and then outputs the resultant as stick data (control signal) 21 after the D/R adjustment.

In order to avoid the complexity of the drawing of FIG. 1, the adjustment section 20 receives the data from only the aileron 1. Similarly, the adjustment section 20 can receive other operation amounts.

Figure 4:
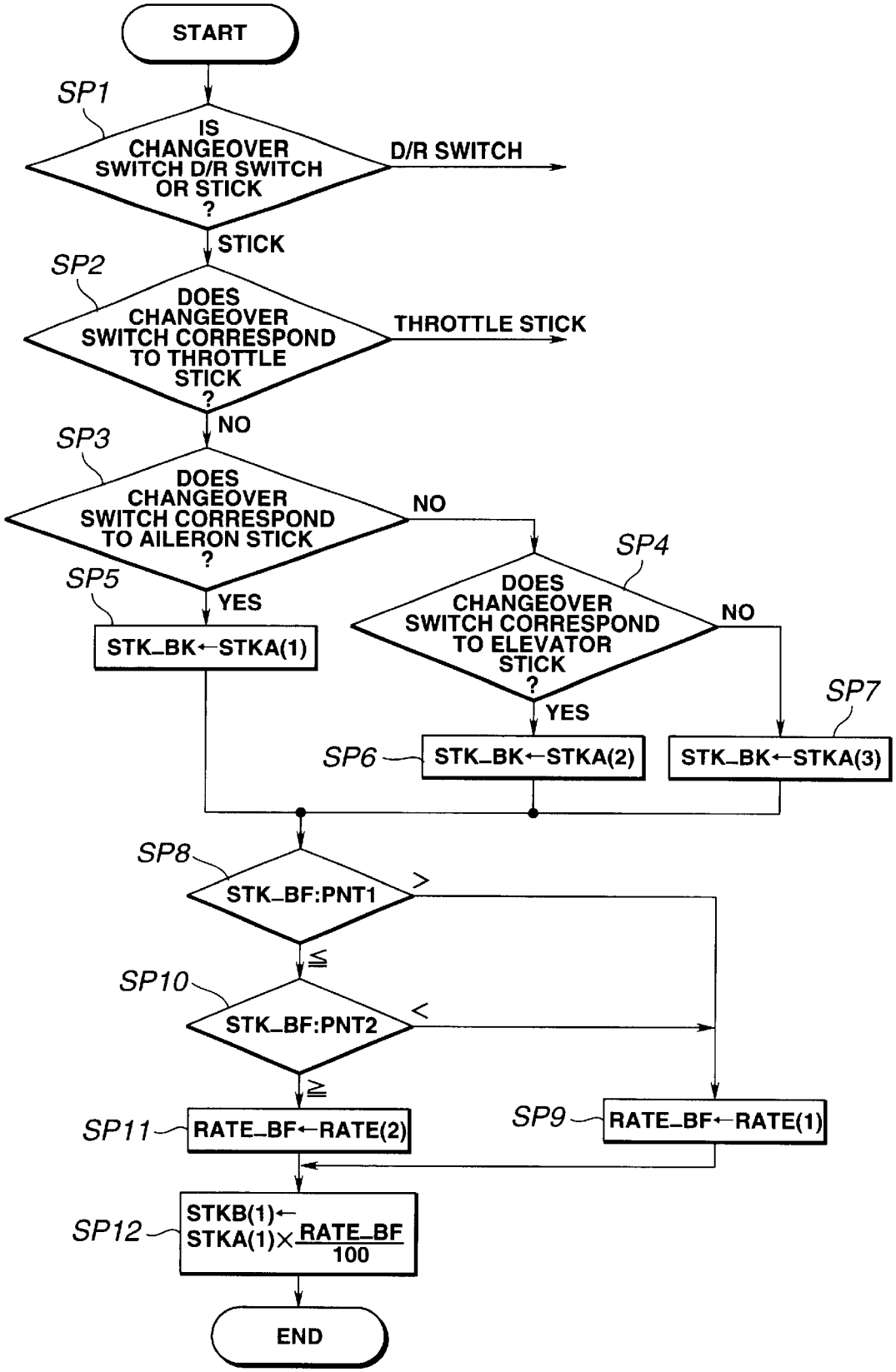
FIG. 4 is a flow chart illustrating the control procedure of a radio control device according to an embodiment of the present invention.
Figure 5:
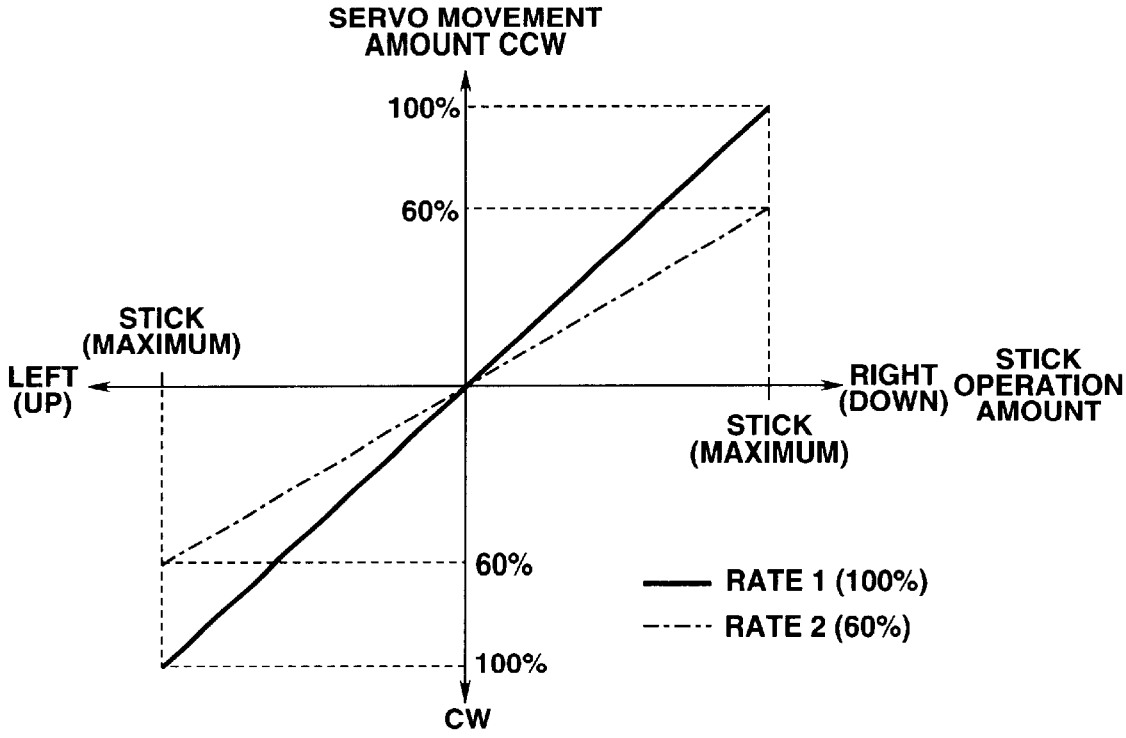
FIG. 5 is a control characteristic chart illustrating relationships between stick operation amount and servo operation amount in a conventional radio control device.
Figure 6:
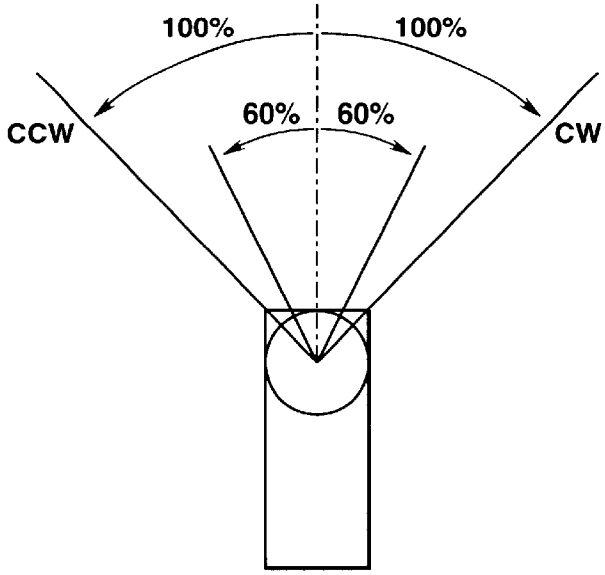
FIG. 6 is a diagram illustrating the operation amount of a servo motor.

Next, an actual control procedure in an automatic switching operation by a stick will be described below with reference to the flowchart of FIG. 4. To avoid the complexity of the drawing, FIG. 4 shows only the data processing procedure for the aileron 1. This data processing procedure is applicable to other operation amounts.

The points 1 and 2 are arbitrarily selected according to the control object. The rate 1 is a rate outside from the region between the rates 1 and 2. The rate 2 is a rate inside the region between the points 1 and 2. The rates 1 and 2 are arbitrarily selected according to the control object.

In the step SP1, it is judged whether the control switcher 8 selects the D/R switch or the stick selects an automatic switching operation. The case where the D/R switch is selected will be described later.

In the step SP2, when the stick selects the automatic switching operation, it is judged whether the throttle stick is selected or another stick is selected.

In the step SP3, when a stick except the throttle 3 is selected, it is judged whether the aileron 1 is selected. In the step SP4, when the aileron 1 is not selected, it is judged whether the elevator 2 is selected.

Thus, selected operation output means is judged according to the results in the steps SP3 and SP4. In the steps 5 to 7, the stick operation amount STKA(1) of the aileron 1, the stick operation amount STKA(2) of the elevator 2 and the stick operation amount STKA(3) of the rudder 4 are stored into the calculation buffer (STK_BF). The processing procedure for the aileron 1 will be described below.

In the step SP8, the stick operation amount stored in the calculation buffer (STK_BF) is compared with the preset value (PNT1) of the point 1. In the step SP9, when the stick operation amount of the calculation buffer (STK_BF) is large, the rate 1 and the preset value of the point 1 are input to the calculation buffer ($RATE_1$ BF).

In the comparison operation in the step SP8, when the stick operation amount of the calculation buffer (STK_BF) is less than the preset value (PNT1) of the point 1, the stick operation amount stored in the calculation buffer (STK_BF) is compared with the preset value (PNT2) of the point 2 in the step SP10.

In the step SP9, when the stick operation amount of the calculation buffer (STK_BF) is larger than PNT1, the value of the rate 1 (RATE(1)) is input to the calculation buffer (RATE_BF).

In the step SP11, when the stick operation amount of the calculation buffer (STK_BF) is PNT2 or more, the value of the rate 2 (RATE(2)) is input to the calculation buffer (RATE_BF).

In the step 12, the operation amount of the aileron 1 stored in the stick operation amount STKA(1) is adjusted by the rate stored in the calculation buffer (RATE_BF). The stick data (control signal, STKB(1)) is obtained after the D/R adjustment.

The above-mentioned procedure corresponds to the case where the stick operated the aileron 1. This procedure is applicable to the elevator 2 and the rudder 4.

The case where the control switcher 8 selects the D/R switch in the step SP1 will be described here. In response to the signal from the control switcher 8, the switcher 15 selectively outputs the output of the D/R switch to the rate switcher 16. The rate switcher 16 selects the value of the rate 1 or the rate 2 stored in the storage means 17. Thus, the operation amount of the aileron 1 is adjusted by the output rate and is output as stick data (control signal) 21 after the D/R adjustment operation.

The case where the stick of the throttle 3 is selected in the step SP2 will be described here. Referring to FIG. 1, the second comparator 14 compares the operation amount of the throttle 3 with the point stored in the storage means 12 and then outputs the comparison result to the switcher 15. The switcher 15 provides the comparison result to the rate switcher 16 in response to the signal from the control switcher 8. The rate switcher 16 selects the rate 1 when the operation amount of the throttle 3 exceeds the point and selects the rate 2 when the operation amount of the throttle 3 is lower than the point. The operation amount of the aileron 1 is adjusted by the rate selectively output and then is output as stick data (control signal) 21 after the D/R adjustment operation.

In the above-mentioned embodiment, the rate is automatically changed according to the stick operation amount of the operation output means (for e.g. the aileron 1). According to the stick operation amount of one operation output means, the similar rate changing control can be provided to the operation output means (for e.g. the aileron 1) and another operation output means (for e.g. the aileron 2). That is, when a rate change characteristic to a stick amount is set to one operation output means, the characteristics of other operation output means can be set in the same manner.

Moreover, as an example of combining plural operation output means, it may be considered to combine the throttle with the pitch of the rotor of a helicopter or to combine the rotor pitch with the rudder.

According to the present invention, the adjustment value determining the relationship between stick operation amount and servo motor operation amount is automatically switched at a changeover point arbitrarily set within a range of operation amounts of a stick. The present invention has the following advantages:

When the rate changing point is set to a position close to a fully-moved stick, an optimum rudder angle can be provided to a preset snap roll by merely operating the snap roll with the stick (or by operating the aileron, the elevator, or the rudder with a fully-moved stick). This feature liberates an operator from the D/R switching operation of switches or the operation of the snap-roll-only switch, difficultly performed during an acrobat flying.

Like the above-mentioned operation, an operator can establish an optimum rudder angle by merely performing the stick operation even during a spinning flying.

A beginner tends to become panic particularly when he is trying to land a model airplane and to excessively move the sticks. In the worst case, excessively operating the elevator results in stalling and crashing the airplane. For respective airplanes, the elevator movement amount in stalling is substantially determined. The rate on a full stick side is previously set to a suitable movement amount not causing stalling. Thus, the stalling can be prevented even if the elevator is fully moved upward with the stick. As described above, the present invention can effectively prevent stalling even when the beginner excessively moves the stick in panic.

What is claimed is:

1. A radio control device, comprising:

means for setting a changeover point;

adjustment value setting means for setting an adjustment value in a region in front of or behind said changeover point;

comparison means for comparing an operation amount of a stick with said changeover point multiple servo motors mounted on a manipulated body; and adjustment value switching means for selecting the adjustment value set by said adjustment value setting means based on outputs of said comparison means, wherein a control signal is output based on a selected adjustment value and the operation amount of said stick, an operation amount of each servo motor is controlled by operating said stick mounted on a transmitter, and an adjustment value determining a relationship between stick operation amount and servo motor operation amount is switched at the changeover point arbitrarily set within a range of stick operation amounts.

2. The radio control device as defined in claim 1, wherein when first servo control of a first stick is performed with said changeover point arbitrarily set and said adjustment value, second servo control of a second stick is performed in a similar manner to said first servo control.

3. A radio control device wherein a stick mounted on a transmitter is operated in two directions oppositely to each other with respect to the origin point so that the operation amount of a servo motor mounted on a manipulated body is controlled in two directions oppositely to each other;

wherein an adjustment value determining a relationship between stick operation amount and servo motor operation amount has a different value between an inner region sandwiched between two changeover points and outer regions other than said region, said two changeover points being arbitrarily set within a range of operation amounts of said stick and sandwiching said origin point.

4. The radio control device as defined in claim 3, wherein when a first changeover point is set within said stick operation amount range, a second changeover point is set at a position which is symmetrical with respect to said first changeover point via said origin point.

5. The radio control device as defined in claim 4, further comprising means for setting said changeover point; adjustment value setting means for setting said two adjustment values; comparison means for comparing an operation amount from said stick with said changeover point; and adjustment value switching means for selecting any one of two adjustment values set to said adjustment value setting means based on an output from said comparison means, whereby a control signal is output based on a selected adjustment value and an operation amount of said stick.

6. The radio control device as defined in claim 3, wherein when first servo control of a first stick is performed with said changeover point arbitrarily set and said adjustment value, second servo control of a second stick is performed in a similar manner to said first servo control.

7. The radio control device as defined in claim 4, wherein when first servo control of a first stick is performed with said changeover point arbitrarily set and said adjustment value, second servo control of a second stick is performed in a similar manner to said first servo control.

8. The radio control device as defined in claim 5, wherein when first servo control of a first stick is performed with said changeover point arbitrarily set and said adjustment value, second servo control of a second stick is performed in a similar manner to said first servo control.

9. A radio control device, comprising:

an input section configured to set a changeover point;

a rate setting section configured to set an adjustment value in a region in the front of or behind said changeover point;

comparators configured to compare an operation amount of a stick with said changeover point; and a switch configured to select an adjustment value set by said rate setting section and based on outputs of said comparators, wherein a control signal is output based on the selected adjustment value and the operation amount of said stick, an operation amount of each servo motor mounted on a manipulated body is controlled by operating a stick mounted on a transmitter, and an adjustment value determining a relationship between stick operation amount and servo motor operation amount is switched at the changeover point arbitrarily set within a range of stick operation amounts.

10. The radio control device as defined in claim 9, wherein when a first servo control of a first stick is performed with said changeover point arbitrarily set and said adjustment value, a second servo control of said a stick is performed in a similar manner to said first servo control.

11. A radio control device comprising:

an input section configured to set a changeover point;

a rate setting section configured to set two adjustment values;

comparators configured to compare an operation amount of a stick with said changeover point; and a switch configured to select any one of said two adjustment values set to said rate setting section based on outputs from said comparators, wherein a control signal is output based on a selected adjustment value and an operation amount of said stick.

12. A radio control device as defined in claim 11, wherein a stick mounted on a transmitter is operated in two directions opposite to each other with respect to an origin point so that an operation amount of each servo motor mounted on a manipulated body is controlled in two directions opposite to each other, and wherein an adjustment value determining a relationship between stick operation amount and servo motor operation amount has a different value between an inner region sandwiched between two changeover points and outer regions other than said inner region, said two changeover points being arbitrarily set within a range of operation amounts of said stick and sandwiching said origin point.

13. The radio control device as defined in claim 12, wherein when a first changeover point is set within said stick operation amount range, a second changeover point is set at a position which is symmetrical with respect to said first changeover point via said origin point.

14. The radio control device as defined in claim 11, wherein when a first servo control of a first stick is performed with said changeover point arbitrarily set and said adjustment value, a second servo control of a second stick is performed in a similar manner to said first servo control.

15. The radio control device as defined in claim 12, wherein when a first servo control of a first stick is performed with said changeover point arbitrarily set and said adjustment value, a second servo control of a second stick is performed in a similar manner to said first servo control.

16. The radio control device as defined in claim 13, wherein when a first servo control of a first stick is performed with said changeover point arbitrarily set and said adjustment value, a second servo control of a second stick is performed in a similar manner to said first servo control.

* * * * *